US012232613B1

(12) United States Patent
Kinsella

(10) Patent No.: US 12,232,613 B1
(45) Date of Patent: Feb. 25, 2025

(54) LONG GUN STORAGE

(71) Applicant: Kevin G. Kinsella, Cooksville, IL (US)

(72) Inventor: Kevin G. Kinsella, Cooksville, IL (US)

( * ) Notice: Subject to any disclaimer, the term of this patent is extended or adjusted under 35 U.S.C. 154(b) by 0 days.

(21) Appl. No.: 18/935,030

(22) Filed: Nov. 1, 2024

Related U.S. Application Data

(60) Provisional application No. 63/597,745, filed on Nov. 10, 2023.

(51) Int. Cl.
*A47B 81/00* (2006.01)
*B65D 25/10* (2006.01)

(52) U.S. Cl.
CPC ..... *A47B 81/005* (2013.01); *B65D 25/106* (2013.01)

(58) Field of Classification Search
CPC .... A47B 81/00; A47B 81/005; B65D 25/106; B60R 7/14; F41C 33/06
See application file for complete search history.

(56) References Cited

U.S. PATENT DOCUMENTS 321,930 A * 7/1885 Wunderlick ..... A47B 81/005 211/64
554,252 A * 2/1896 Falk ..... F41A 23/18 211/64
945,520 A * 1/1910 Greenwood ..... F41A 23/18 248/175
1,202,588 A * 10/1916 Roberts ..... A47B 81/00 312/297
2,998,885 A * 9/1961 Surface ..... A47B 81/005 248/316.4
3,468,427 A * 9/1969 Leslie ..... G09F 5/00 211/64
3,802,612 A * 4/1974 Smith ..... B60R 7/14 211/8
4,018,339 A 4/1977 Pritz
4,174,042 A * 11/1979 Fair ..... A47B 81/005 211/8
4,271,969 A * 6/1981 Gnesa ..... F41A 23/18 248/156
4,570,890 A * 2/1986 Lohn ..... F41A 23/00 248/309.2
4,760,985 A * 8/1988 Stewart ..... B64G 4/00 248/176.1
5,012,965 A * 5/1991 Miller ..... F41C 33/0209 224/230
5,188,328 A * 2/1993 Thompson ..... F41C 33/048 248/309.2
5,503,276 A 4/1996 Pierce
5,579,923 A * 12/1996 Hemmerlein ..... F41A 23/18 42/70.11

(Continued)

FOREIGN PATENT DOCUMENTS

CA 2272529 A1 * 11/1999 ..... A47B 81/005

*Primary Examiner* — Stanton L Krycinski
(74) *Attorney, Agent, or Firm* — Philip L. Bateman

(57) ABSTRACT

An apparatus enables a long gun to be stored upright in a cabinet having a floor and an overhanging surface. The apparatus has: (a) a rod adapted for insertion into the gun barrel; (b) a cap attached to the top of the rod; (c) a hook-and-loop fabric, a magnet, or the like for removably attaching the cap to the underside of the overhanging surface; (d) a first ring in a fixed position at the bottom of the rod; and (e) a second ring in a movable position on the rod between the top and the bottom of the rod.

20 Claims, 2 Drawing Sheets

(56) References Cited

U.S. PATENT DOCUMENTS 5,806,739 A * 9/1998 Wood ..... F41A 23/18 224/555
6,427,497 B1 * 8/2002 Mossberg, Jr. ..... F41A 23/18 211/8
6,843,081 B1 * 1/2005 Painter ..... F41C 33/06 42/70.11
7,500,572 B2 3/2009 Lane et al.
7,735,253 B2 * 6/2010 Giebel ..... F41C 33/06 42/70.11
7,963,406 B2 6/2011 Kinsella
8,006,424 B1 * 8/2011 Ligard ..... F41A 17/02 42/70.11
8,739,982 B2 * 6/2014 Werner ..... F41A 23/18 211/119.003
9,347,729 B2 * 5/2016 Hancosky ..... F41A 23/18
9,574,847 B2 * 2/2017 Rossi ..... F41C 33/048
9,683,804 B2 * 6/2017 Hartness ..... F41A 29/02
10,018,441 B1 * 7/2018 Kinsella ..... A47F 5/0807
10,234,236 B2 * 3/2019 Patterson ..... F41C 33/048
D847,488 S * 5/2019 McGrath ..... D3/201
11,006,746 B2 * 5/2021 Smith ..... A47B 81/005
11,589,676 B2 * 2/2023 Rettig ..... A47B 81/005
12,018,912 B2 * 6/2024 Cosico ..... F41C 33/06
2005/0133473 A1 6/2005 Lesperance
2008/0086927 A1 * 4/2008 Wajdic ..... F41A 17/44 42/70.11
2009/0078661 A1 * 3/2009 Kinsella ..... A47B 81/005 211/64
2012/0255979 A1 * 10/2012 Sitz ..... F41C 33/0245 42/90
2012/0261368 A1 * 10/2012 Klein ..... A47B 81/005 211/64
2019/0011222 A1 * 1/2019 Suggs ..... E05G 1/024
2020/0054129 A1 * 2/2020 Woods ..... A47B 81/005

* cited by examiner

LONG GUN STORAGE

CROSS-REFERENCE TO RELATED APPLICATION

This application claims the benefit of U.S. Provisional Patent Application Ser. No. 63/597,745, Nov. 10, 2023.

FIELD OF THE INVENTION

The invention relates to the upright storage of long guns in a cabinet.

BACKGROUND OF THE INVENTION

Long guns are firearms with long barrels, such as rifles, shotguns, and the like. Long guns are commonly stored in an upright position in cabinets or safes. The terms "cabinet" and "safe" are used interchangeably herein to refer to any container that is adapted for storing long guns in an upright position with a floor and an overhanging surface located a relatively short distance above the tip of the gun barrel. The term "overhanging surface" is used herein to refer to any horizontal surface directly above the tip of the gun barrel and includes shelves, roofs, projections, and the like.

A gun cabinet typically contains slotted racks against which the gun barrels rest. An example of such a gun cabinet is disclosed in Lesperance, U.S. Pat. Appln. Publn. No. 2005/0133473, published Jun. 23, 2005. The slots are generally spaced apart a sufficient distance to accommodate relatively wide long guns, such as bolt-action rifles, double-barrel shotguns, and guns containing scopes. Accordingly, gun cabinets do not provide optimized storage for narrower guns. Another problem with such gun cabinets is that the long guns can fall over if they are not placed in a stable, leaning over position.

Removing a gun from a cabinet is cumbersome. The gun owner must bend down, tip the gun forward with one hand, raise the stock of the gun up with the other hand to clear the door jam, and then slide the stock forward at a 45 degree angle through the slot without scraping the guns behind it. Removing a gun from the back of the cabinet is even more difficult. To remove a gun from the back of the cabinet, it is often necessary to remove many of the guns in the front to create an open pathway. Placing a gun into a cabinet is equally cumbersome.

Another problem associated with conventional gun cabinets is that resting the barrel of the gun against the rack, even if the slots are covered with felt or cloth, causes a deterioration of the bluing on the barrel.

Kinsella, U.S. Pat. No. 7,963,406, Jun. 21, 2011, hereby incorporated by reference in its entirety, discloses a long gun storage apparatus comprising a rod with a cap having a hook-and-loop fabric or a magnet that mates with a corresponding surface on the underside of an overhanging surface such as a shelf. The Kinsella apparatus is shown in FIGS. 1 to 3. The diameter of the rod of the Kinsella apparatus is slightly less than the smallest diameter of the barrel of the long guns being stored. The diameter of long gun barrels varies. For example, a .17 caliber rifle has a barrel diameter of 0.17 inches while a 10 gauge shotgun has a barrel diameter of 0.78 inches. When the Kinsella apparatus is used with a long gun having a barrel with a larger diameter, the long gun leans slightly rather than staying perfectly upright.

Other gun storage apparatuses are disclosed in Pritz, U.S. Pat. No. 4,018,339, Apr. 19, 1977; Pierce, U.S. Pat. No. 5,503,276, Apr. 2, 1996; and Lane et al., U.S. Pat. No. 7,500,572, Mar. 10, 2009. None of these patents discloses a long gun storage apparatus having a rod with a diameter that is slightly less than the diameter of rifle barrels and that is easily adaptable for use with long guns having larger barrel diameters such as shotguns.

Accordingly, a demand exists for improved long gun storage. A more particular object is to provide a long gun storage apparatus having a rod with a diameter that is slightly less than the diameter of rifle barrels and that is easily adaptable for use with long guns having larger barrel diameters such as shotguns.

SUMMARY OF THE INVENTION

The general object of this invention is to provide improved long gun storage. A more particular object is to provide a long gun storage apparatus having a rod with a diameter that is slightly less than the diameter of rifle barrels and that is easily adaptable for use with long guns having larger barrel diameters such as shotguns.

I have invented an apparatus for the upright storage of a long gun having a length and a barrel with an inside diameter in a cabinet having a floor and an overhanging surface at a height greater than the length of the long gun. The apparatus comprises: (a) a rod having a thickness less than the inside diameter of the gun barrel and having a length greater than the difference between the height of the surface and the length of the gun, the rod being adapted for insertion into the gun barrel; (b) a cap attached to one end of the rod, the cap having a thickness greater than the inside diameter of the gun barrel, the cap being adapted for limiting the insertion of the rod into the gun barrel; (c) a means for removably attaching the cap to the underside of the overhanging surface; (d) a first ring in a fixed position at the bottom of the rod; and (e) a second ring in a movable position between the top of the rod and the bottom of the rod.

I have also invented a method for storing a long gun in a cabinet. The method comprises: (a) providing a long gun having a length and a barrel with an inside diameter; (b) providing a cabinet having a floor and a roof or shelf forming an overhanging surface at a height above the floor that is greater than the length of the long gun; (c) providing a long gun storage apparatus comprising: (i) a rod having a top, a bottom, a thickness less than the inside diameter of the gun barrel, and a length greater than the difference between the height of the surface and the length of the gun, the rod being adapted for insertion into the gun barrel; (ii) a cap attached at the top of the rod, the cap having a width greater than the inside diameter of the gun barrel, the cap being adapted for limiting the insertion of the rod into the gun barrel; (iii) a means for removably attaching the cap to the underside of the overhanging surface; (iv) a first ring in a fixed position at the bottom of the rod; and (v) a second ring in a movable position between the top of the rod and the bottom of the rod; (d) inserting the rod of the long gun storage apparatus into the barrel of the long gun; (e) placing the long gun in an upright position on the floor of the cabinet with the overhanging surface directly above; and (f) raising the cap of the apparatus to removably attach it to the overhanging surface.

The long gun storage apparatus of this invention enables a long gun with a relatively large barrel diameter to be stored perfectly upright. The apparatus also provides optimal flexibility, increased capacity, easier removal, greater security, and less damage.

DETAILED DESCRIPTION OF THE INVENTION

Figure 3:
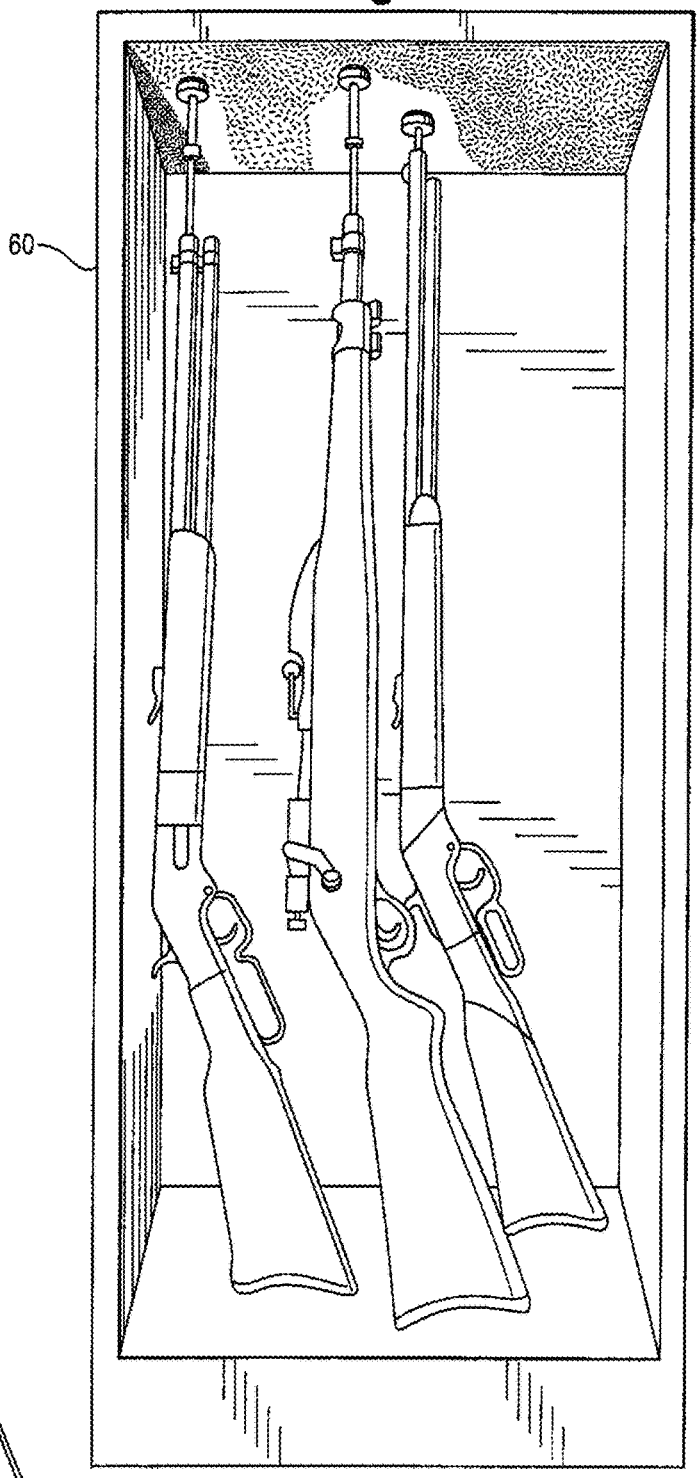
FIG. 3 is a perspective view thereof showing a plurality of guns stored in a cabinet.
Figure 4:
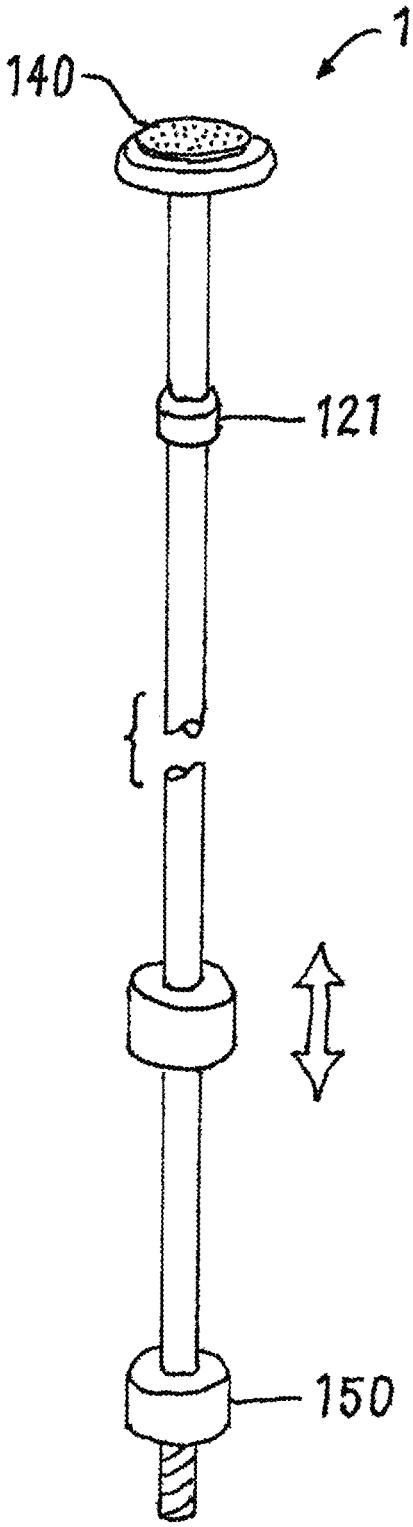
FIG. 4 is a perspective view of a first embodiment of the storage apparatus of this invention.

This invention is best understood by the reference to the drawings. FIG. 4 shows a first preferred embodiment of the long gun storage apparatus 100 of this invention. The apparatus comprises a rod 120, a cap 130 at the top of the rod, a circular patch 140 of hook-and-loop fabric attached to the top of the cap, a first ring 150 at the bottom of the rod, and a second ring 160 between the first ring and the cap. These components are discussed in detail below. The apparatus enables a long gun with a large barrel diameter to be stored perfectly upright in a cabinet with an overhanging surface as shown in FIG. 3. Unless otherwise indicated expressly or by context, the term "about" is used herein to mean plus or minus 25 percent of the measurement or other quantified property referenced.

As discussed below, the rod 120 is inserted into the barrel of the long gun. Therefore, the rod has a maximum thickness that is less than the inside diameter of the barrel. In the case where the rod has a round cross section, the thickness of the rod is equal to its outside diameter. The inside diameters of long gun barrels vary from about 17 caliber (0.17 inch) to about 78 caliber (0.78 inch). Accordingly, the thickness of the rod is generally about one-tenth to one-half (0.1 to 0.5) inch. The thickness of the rod is preferably about three-sixteenths (about 0.19) inch. The rod is preferably cylindrical (i.e., it has a round cross section) to conform to the shape of the barrel, but other shapes are also suitable.

As also discussed below, the apparatus extends from inside the barrel of the gun up to the overhanging surface, generally either a shelf or the roof of a cabinet. Accordingly, the length of the rod is greater than the difference between the height of the shelf and the length of the gun. For example, if the gun has a length of fifty inches and the height of the overhanging surface is fifty-six inches, the rod must have a length greater than six inches. The rod preferably extends downwardly into the barrel for a distance of at least about two inches. Therefore, in the above example, the rod is preferably at least about eight inches long. The rod is generally about two to twenty-four inches long and is preferably about six to eighteen inches long. If the rod is longer than about twenty-four inches, it is more costly to produce, more likely to break, and may even bottom out inside the barrel which could prevent its use with a relatively short gun in a cabinet with a relatively low shelf.

The rod is made of a strong, stiff material that does not bow excessively and that does not scratch or damage the inside of a rifle barrel. Suitable materials include fiberglass, graphite, thermoplastic (e.g., nylon polyamide, polyethylene, polypropylene, polyvinylchloride, etc.), wood, thermoplastic-coated metals, and the like. A nylon polyamide rod is preferred because of its strength, resiliency, and ease at sliding into and out of a barrel.

The cap 130 is attached to the top end of the rod. The cap is perpendicular to the longitudinal axis of the rod. The cap serves two purposes. The first purpose is to limit the insertion of the rod into the barrel. Without the cap, the rod could easily slide down into the barrel where it could not be retrieved without turning the gun upside down. The second purpose, as discussed in more detail below, is to provide a larger area for the means of removably securing to the underside of the overhanging shelf. Accordingly, the cap is larger in width than the inside diameter of the gun barrel. The cap is preferably a disk having a diameter of about one-half to two inches. The cap is preferably molded as an integral part with the rod.

The cap includes a means for removable attachment to the underside of the overhanging surface. In the preferred embodiment, the top of the cap is covered with a circular patch of hook-and-loop fabric 140. An example of such fabric is the type sold commercially under the VELCRO trademark. The underside of the overhanging surface is covered with the mating hook-and-loop fabric. It is most preferred that the cap contain a patch of the hook fabric and the overhanging surface be covered with the loop fabric. Another preferred means of removable attachment is a magnetic disk or ring attached to the cap for use with an overhanging shelf made of steel or other ferromagnetic material. Other means of attachment, including multiple receiving holes or slots in the overhanging surface, are also suitable.

A first ring 150 is in a fixed position at the bottom of the rod. The first ring, in combination with the second ring, locates the rod in the center of the barrel. The first ring has an outside diameter slightly less than the diameter of the long gun barrel. The diameter is generally about three-eighths to three-quarters (about 0.38 to 0.75) inches. The diameter is preferably about five-eighths (about 0.63) inches. The first ring generally has a thickness of about one-eighth to one-half (0.13 to 0.5) inches. The first ring preferably has a thickness of about one-fourth (0.25) inches. The first ring is generally made of natural rubber, a resilient thermoplastic such as chloroprene, neoprene, silicone, ethylene propylene diene monomer (EPDM), polyvinyl chloride (PVC), styrene butadiene rubber (SBR), etc., or a less resilient thermoplastic such as nylon polyamide, polyethylene, polypropylene, polyvinylchloride, etc. The first ring is preferably fixed in position at the bottom of the rod in such a way that the first ring can be easily removed if desired. The first ring is preferably threaded upon threads at the bottom of the rod. Other means of attachment are also suitable, including barbs, ridges, projections, and the like.

A second ring 160 is in a movable position on the rod between the cap at the top and the first ring at the bottom. The second ring, in combination with the first ring, locates the rod in the center of the barrel. The second ring fits snugly upon the rod so it is easily moved along the rod and remains in position where desired. The second ring has an outside diameter similar or equal to the diameter of the first ring. The second ring is generally made of natural rubber or a resilient thermoplastic such as chloroprene, neoprene, silicone, ethylene propylene diene monomer (EPDM), polyvinyl chloride (PVC), styrene butadiene rubber (SBR), etc. The second ring generally has thickness of about one-fourth to three-quarters (0.25 to 0.75) inches. The second ring preferably has a thickness of about one-half (0.5) inches.

Figure 5:
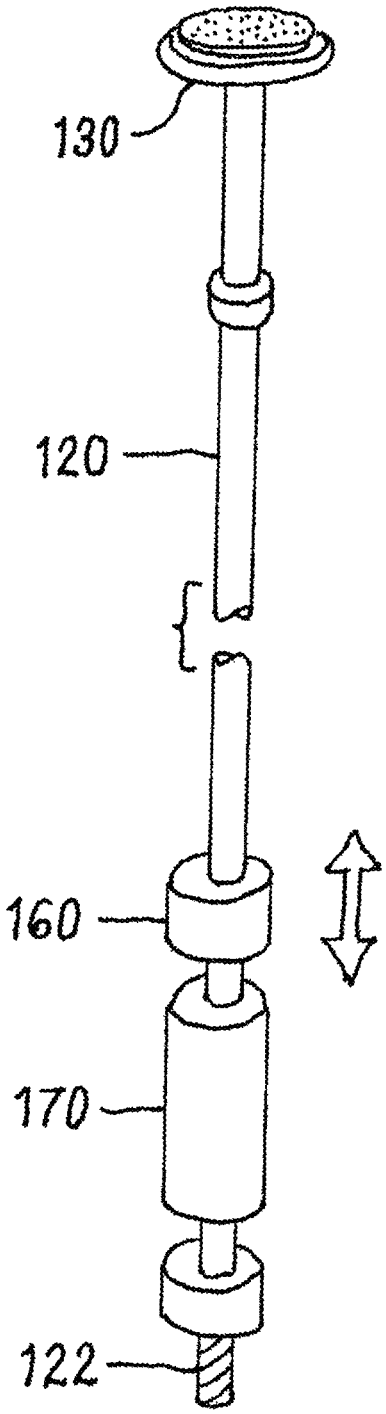
FIG. 5 is a perspective view of a second embodiment of the storage apparatus of this invention.

Referring to FIG. 5, an optional foam cleaning ring 170 is positioned between the first ring and the second ring. The foam cleaning ring, in combination with the first ring and the second ring, locates the rod in the center of the barrel. The foam cleaning ring also helps to clean the inside of the barrel of the long gun. The foam cleaning ring fits snugly upon the rod so it is easily moved along the rod and remains in position where desired. The foam cleaning ring has an outside diameter similar or equal to the diameter of the first ring. The foam cleaning ring is generally made of a foam such as polyurethane. The foam cleaning ring generally has a thickness of about one to three inches. The foam cleaning ring preferably has a thickness of about two inches.

The two preferred embodiments of the apparatus shown in FIGS. 4 and 5 are made of nylon polyamide and have a length of about sixteen inches. The caps have a diameter of about one inch and contain a patch of VELCRO hook fabric. The rods have a diameter of about three-sixteenths (about 0.19) inch. A slightly protruding rib 121 located near the cap provides a gripping surface. The first ring is secured on threads 122 at the bottom of the rod. The second ring is movable to any position along the rod between the first ring and the cap. The second preferred embodiment differs from the first in having a foam cleaning ring.

The use of the long gun storage apparatus can now be considered. The long gun storage apparatus of this invention is used in a similar way as the Kinsella apparatus shown in FIGS. 2 to 3 with two exceptions. First, the long gun storage apparatus of this invention is used with its rings in place only with long guns having a relatively large diameter barrel such as shotguns. Second, the movable ring is preferably moved up the rod to a location that will be close to the tip of the barrel before insertion. This maximizes the distance between the first ring and the second ring and provides optimal centering of the rod within the barrel. This, in turn, perfects the verticality of the long gun during storage.

Figure 1:
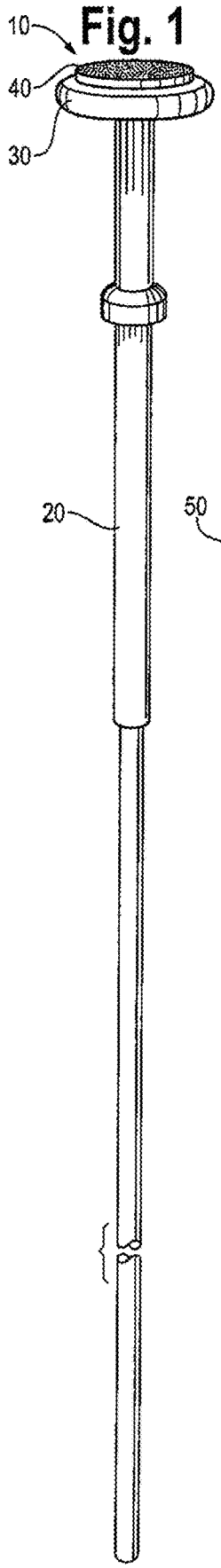
FIG. 1 is a perspective view of a prior art gun storage apparatus.
Figure 2:
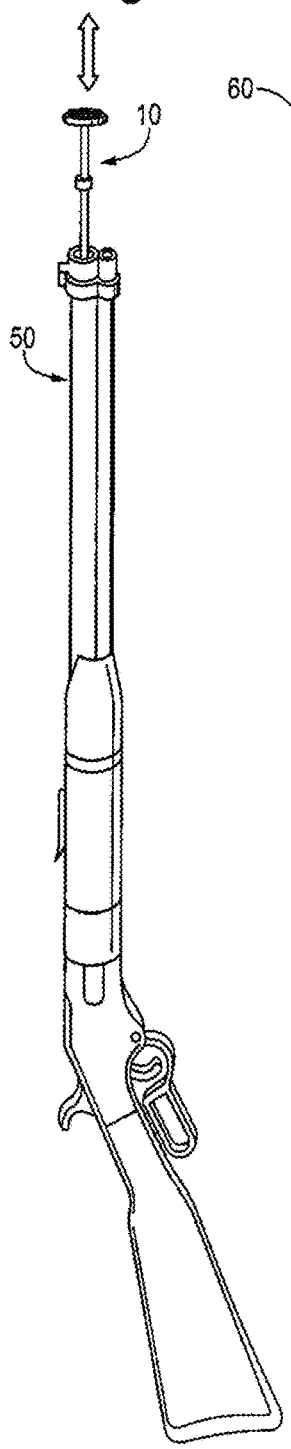
FIG. 2 is a perspective view thereof in the barrel of the gun.

FIG. 2 shows how the storage apparatus is inserted into the barrel of a long gun. FIG. 3 shows three long guns stored in a cabinet whose door is omitted for clarity. As explained above, long guns having a relatively small barrel diameter are shown in FIGS. 2 and 3 for illustration purposes. The storage apparatus of this invention is used with long guns having a relatively large diameter barrel. The apparatus in each barrel contacts the overhanging roof of the cabinet. To position the gun, the gun owner simply sets the stock of the gun in the desired location and pulls the storage apparatus up until the cap contacts the underside of the overhanging surface. The attachment of the mating hook-and-loop fabrics, magnet, or other means is sufficient to hold the storage apparatus securely in place which, in turn, holds the long gun in place. Once the cap is attached to the surface, there is no danger of the gun tipping over. To remove the gun, the cap is pulled away from the surface, the gun is tilted, and then lifted out.

It can be appreciated that the apparatus gives the gun owner the flexibility to arrange his long guns in whatever pattern he wishes in the cabinet. This flexibility enables the gun owner to maximize the number of long guns stored in the cabinet, if desired. It also enables the gun owner to quickly and easily change the arrangement as seasons change or as long guns are added or removed from his collection. It can also be appreciated that nothing contacts the exterior of the gun barrel during storage. As a result, no damage is done to the finish of the metal. It can be further appreciated that the rings can be easily removed if it is desired to use the apparatus with a long gun having a smaller diameter. Whether used without the rings with a long gun having a small diameter or used with the rings with a long gun having a large diameter, the apparatus enables the long gun to be stored perfectly upright without any appreciable leaning.

In most applications, the rings and the hook-and-loop fabrics function well without any service for many years. If and when the elements need to be cleaned or replaced, the operation is performed quickly and easily without the use of any tools.

I claim:

1. An apparatus for the upright storage of a long gun in a cabinet having a floor and an overhanging surface, the apparatus comprising:

(a) a rod having a top and a bottom, a thickness of about one-tenth to one-half inch, and a length of about two to twenty-four inches;

(b) a cap having a width of about one-half to two inches attached to the top of the rod; and (c) a magnet or a hook-and-loop fabric attached to the cap;

(d) a first ring on the rod in a fixed position at the bottom of the rod; and (e) a second ring on the rod in a movable position on the rod between the top and the bottom of the rod;

such that when the rod of the apparatus is inserted into a barrel of a long gun and the long gun is then placed in an upright position on a floor of a cabinet with an overhanging surface located above the barrel a distance of about one to twenty-two inches and being made of a ferromagnetic material and/or covered with a hook-and-loop fabric, the apparatus is adapted to be raised to attach the cap to the overhanging surface while a portion of the rod remains in the barrel and thereby secure the long gun in a stable and vertical storage position.

2. The apparatus of claim 1 wherein the bottom of the rod is threaded and the first ring is positioned upon the threads of the rod.

3. The apparatus of claim 1 wherein the first ring and the second ring are formed of a resilient material.

4. The apparatus of claim 1 additionally comprising: (f) a foam cleaning ring on the rod positioned between the first ring and the second ring.

5. The apparatus of claim 1 wherein the cap is perpendicular to the rod.

6. The apparatus of claim 1 wherein the rod and cap are made of fiberglass, graphite, thermoplastic, wood, or plastic-coated metal.

7. The apparatus of claim 1 wherein the rod is cylindrical with a diameter of about one quarter inch and has a length of about six to eighteen inches.

8. An apparatus for the upright storage of a long gun having a length and a barrel with an inside diameter in a cabinet having a floor and an overhanging surface at a height greater than the length of the long gun, the apparatus comprising:

(a) a rod having a top, a bottom, a thickness less than the inside diameter of the gun barrel, and a length greater than the difference between the height of the surface and the length of the gun, the rod being adapted for insertion into the gun barrel;

(b) a cap attached to one end of the rod, the cap having a width greater than the inside diameter of the gun barrel, the cap being adapted for limiting the insertion of the rod into the gun barrel;

(c) a means for removably attaching the cap to the underside of the overhanging surface;

(d) a first ring in a fixed position at the bottom of the rod; and (e) a second ring in a movable position on the rod between the top and the bottom of the rod.

9. The apparatus of claim 8 wherein the bottom of the rod is threaded and the first ring is positioned upon the threads of the rod.

10. The apparatus of claim 8 wherein the first ring and the second ring are formed of a resilient material.

11. The apparatus of claim 8 wherein the rod is cylindrical with a length of about six to eighteen inches and a diameter of about one-tenth to one-half inch.

12. The apparatus of claim 8 wherein the rod and cap are made of fiberglass, graphite, thermoplastic, wood, or thermoplastic-coated metal.

13. The apparatus of claim 8 wherein the removable attachment means comprises hook-and-loop fabric.

14. The apparatus of claim 8 wherein the removable attachment means comprises a magnet.

15. A method for storing a long gun in a cabinet, the method comprising:

(a) providing a long gun having a length and a barrel with an inside diameter;

(b) providing a cabinet having a floor and a roof or shelf forming an overhanging surface at a height above the floor that is greater than the length of the long gun;

(c) providing a long gun storage apparatus comprising: (i) a rod having a top, a bottom, a thickness less than the inside diameter of the gun barrel, and a length greater than the difference between the height of the surface and the length of the gun, the rod being adapted for insertion into the gun barrel; (ii) a cap attached at the top of the rod, the cap having a width greater than the inside diameter of the gun barrel, the cap being adapted for limiting the insertion of the rod into the gun barrel; (iii) a means for removably attaching the cap to the underside of the overhanging surface; (iv) a first ring in a fixed position at the bottom of the rod; and (v) a second ring in a movable position between the top of the rod and the bottom of the rod;

(b) inserting the rod of the long gun storage apparatus into the barrel of the long gun;

(c) placing the long gun in an upright position on the floor of the cabinet with the overhanging surface directly above; and (d) raising the cap of the apparatus to removably attach it to the overhanging surface.

16. The method of claim 15 wherein the rod is cylindrical with a length of about two to twenty-four inches and a diameter of about one-tenth to one-half inch.

17. The method of claim 15 wherein the rod and cap are integral and made of fiberglass, graphite, thermoplastic, wood, or thermoplastic-coated metal.

18. The method of claim 15 wherein the removable attachment means comprises hook-and-loop fabric.

19. The method of claim 15 wherein the removable attachment means comprises a magnet.

20. The method of claim 15 wherein the bottom of the rod is threaded and the first ring is positioned upon the threads of the rod.

* * * * *